United States Patent [19]

Ash

[11] 4,254,650

[45] Mar. 10, 1981

[54] APPARATUS FOR MAKING ALUMINUM WHEEL COVERS

[75] Inventor: Stanley P. Ash, Greenville, Mich.

[73] Assignee: International Telephone and Telegraph Corporation, New York, N.Y.

[21] Appl. No.: 905,382

[22] Filed: May 12, 1978

Related U.S. Application Data

[62] Division of Ser. No. 605,037, Aug. 15, 1975, abandoned.

[51] Int. Cl.[3] ..... B21D 22/00

[52] U.S. Cl. ..... 72/357; 29/159.01; 113/116 E

[58] Field of Search ..... 72/357, 353, 379, 359; 113/116 E; 29/159.01

[56] References Cited

U.S. PATENT DOCUMENTS

| | | | |
|---|---|---|---|
| 2,163,003 | 6/1939 | Lyon | 113/116 E |
| 2,254,376 | 7/1941 | Lyon | 29/159.01 |
| 3,001,495 | 9/1961 | Lyon | 29/159.01 X |

*Primary Examiner*—Leon Gilden

*Attorney, Agent, or Firm*—James B. Raden; William J. Michals

[57] ABSTRACT

The apparatus and method disclosed herein provides a phantom draw bead in a generally flat, aluminum sheet metal blank which is ultimately formed into the ornamental cover member of an automotive wheel cover. The material of the draw bead functions as a conventional draw bead to secure the blank during the forming process, but becomes an external, visible and integral part of the finished product of the process. In working the process, the aluminum blank is inserted between the cooperating dies of a blank-and-draw press. The dies are then closed to form the phantom draw bead along the outer annular margin of the blank, and, thereafter, to draw the blank over the stationary die. The drawn blank is thereafter slightly trimmed and inserted between the cooperating dies of a restrike press, and the dies are closed to form the final profile of the cover member wherein the finished surface includes the material which previously provided the draw bead. Accordingly, the waste material requirement of a conventional draw bead is avoided.

4 Claims, 6 Drawing Figures

APPARATUS FOR MAKING ALUMINUM WHEEL COVERS

This is a division of application Ser. No. 605,037 filed 8/15/75, now abandoned.

BACKGROUND OF THE INVENTION

This invention relates to aluminum wheel covers, and more particularly, to an aluminum wheel cover wherein a phantom draw bead is utilized during the manufacturing operation.

Wheel covers are well known to the art and are generally drawn from a blank of relatively thin sheet metal into a generally circular configuration having a given ornamental profile or given design contours. These wheel covers have been formed from cold work hardened material such as brass and, more prevalently, stainless steel. The cover is fastened to the automotive wheel by means of resilient teeth which are either provided integral with the cover member or by way of a retention bank which, in turn, is suitably fastened to the cover member such as by rolling or clinching an outer edge of the cover member about the retention band. More recently, wheel covers have been provided as a two piece aluminum wheel cover wherein the cover member is provided of aluminum which is attached to a stainless steel retention band. Such aluminum wheel covers are disclosed in the copending application of L. Kafoure and D. J. Toal, Ser. No. 551,095, filed Feb. 20, 1975, which is assigned to the same assignee as the present invention.

The prior art stainless steel wheel covers are formed by placing a sheet metal blank between the cooperating dies of a press. The dies are then advanced toward one another until an outer annular portion of the upper die engages and clamps a corresponding outer annular margin of the blank while forming a draw bead thereat. The draw bead is utilized to secure the blank from undesired movement during the subsequent forming operation wherein the sheet metal blank is essentially pulled over the lower die to provide the desired profile or contours. Thereafter, the draw bead is trimmed off as waste or scrap material and the remaining drawn blank is subjected to subsequent restrike and forming steps to provide the desired finished product. In the U.S. Pat. No. 3,001,494, to Lyon there is disclosed a method and apparatus wherein a portion of an external draw bead is deliberately drawn in a direction toward the center of the blank during the forming operation thereby to minimize the scrap material. It can be seen by reference to this patent, however, that substantial scrap nevertheless results. Further, the portion of the draw bead which is drawn radially inwardly is disposed along the outer annular radially facing flange which is subsequently turned over and which therefore is not visible from the external surface of the finished product.

Aluminum wheel covers have been provided in limited duty applications such as recreational vehicles or campers. These covers have utilized a relatively thick, soft and generally unfinished (i.e., not annodized or otherwise surface treated) cover member which is fabricated to attain the desired shape and contours. This has the disadvantage that the thickness results in a relatively heavy and expensive cover; which is not particularly durable due to the soft characteristics of the aluminum; and, when the aluminum is unfinished it is generally unacceptable in terms of meeting the decorative requirements of the industry which is accustomed to polished stainless steel wheel cover surfaces.

These and other disadvantages are overcome by the present invention wherein apparatus and method are provided for making generally circular aluminum wheel cover members in a drawing process wherein minimum blank sizes are accommodated and wherein the aluminum material can possess the desired hardness and treated surface properties. This is accomplished by utilizing a phantom draw bead in accordance with the principles of the present invention.

SUMMARY OF THE INVENTION

Briefly, the present invention provides apparatus and a method for making generally circular aluminum wheel cover members having a given diameter. The method comprises the steps of inserting an aluminum blank between cooperating dies of a press. Thereafter, the dies are closed to form a bead along an annular margin of the blank wherein the diameter of the bead is less than the given diameter; and to thereafter draw the blank over the stationary die of the press. The partially formed cover member is then inserted between a second set of cooperating restrike dies; and, the restrike dies are closed over the surface of the drawn blank which includes the bead surface portion therein, and wherein the finished part includes substantially all of the material of the bead.

BRIEF DESCRIPTION OF THE DRAWINGS

The advantages of this invention will become more readily appreciated as the same becomes completely understood by reference to the following detailed description when taken in conjunction with the accompanying drawing wherein.

DETAILED DESCRIPTION

Figure 1:
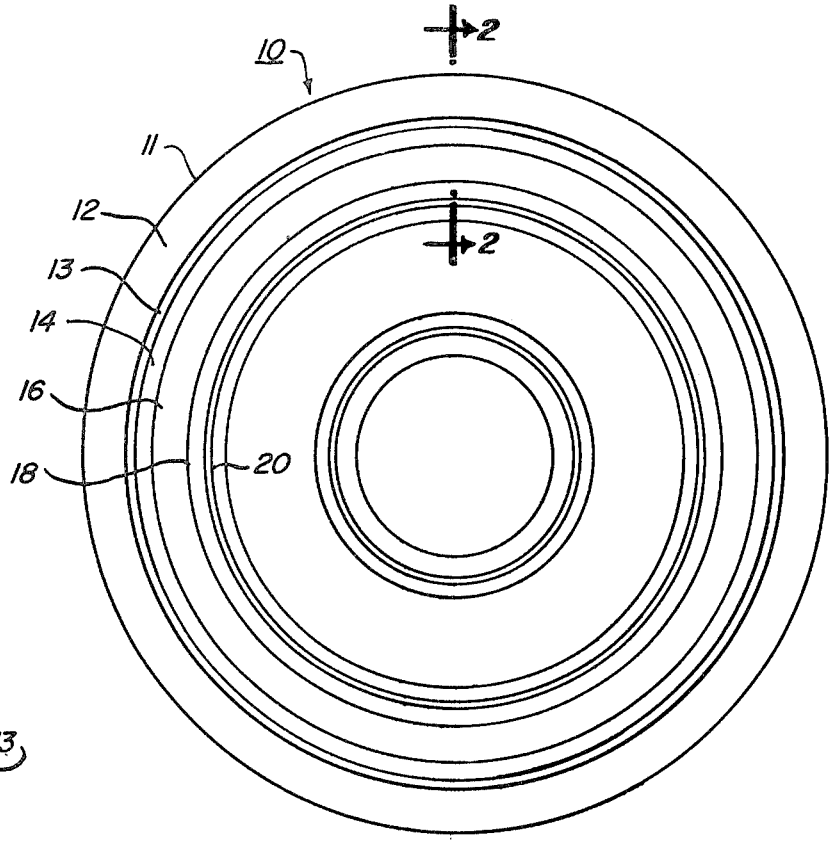
FIG. 1 is a plan view of an aluminum wheel cover member in accordance with the teachings of the present invention.
Figure 2:
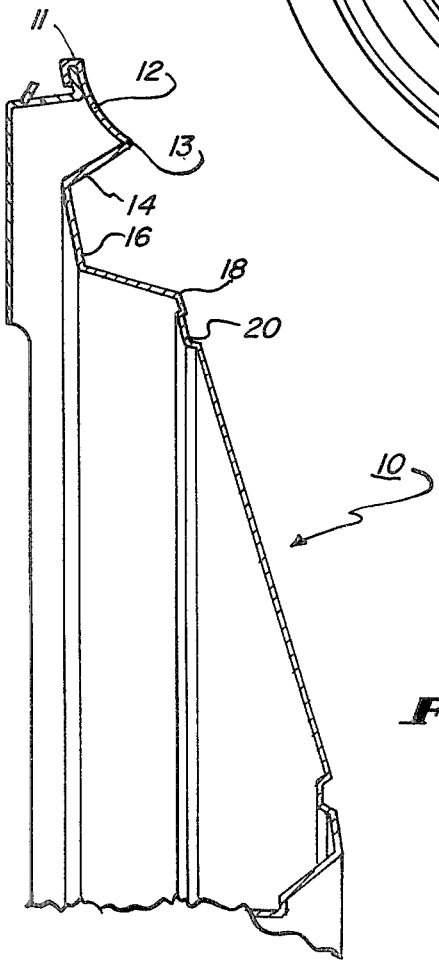
FIG. 2 is a cross-sectional view of the wheel cover member of FIG. 1 taken along the line 2—2 thereof.

Referring now to FIGS. 1 and 2, there are shown generally at 10 the completed finished product, or wheel cover member, of the present invention. The wheel cover member 10 forms the ornamental, external visible portion of the completed wheel cover and is suitably fastened to a retaining ring or any other suitable retention means such as by spinning or clinching the axially directed outer flange portion 11 about a mating flange or portion of the retention ring. Provided radially inwardly from outer flange 11 are the desired grooves and contours to meet a given ornamental design requirement. For example, the flange 11 blends axially outwardly into a pronounced rib 12 which terminates at a peak 13 and thereafter drops axially inwardly along peak portion 14. Thereafter, the cover member 10 is provided with several other ornamental grooves or contours such as 16, 18 and 20 and finally terminates in a second radially directed inner flange 22. Flange 22 as shown in FIGS. 1 and 2 readily accomodates a suitable medallion (not shown) or any other decorative device. That is, flange 22 may be clinched or spun about a given medallion which may comprise a metal or plastic material. As will be described more fully hereinafter, the portion of the material of cover member 10 which forms rib 12 is also utilized as a compromise or "phantom" draw bead during the manufacturing process in accordance with the present invention. It can be seen that rib 12 forms a decorative but structural function and moreover, forms a visible part of the wheel cover member. That is, portion 12 retains its "Class A" finish during and after the manufacturing process.

Figure 3:
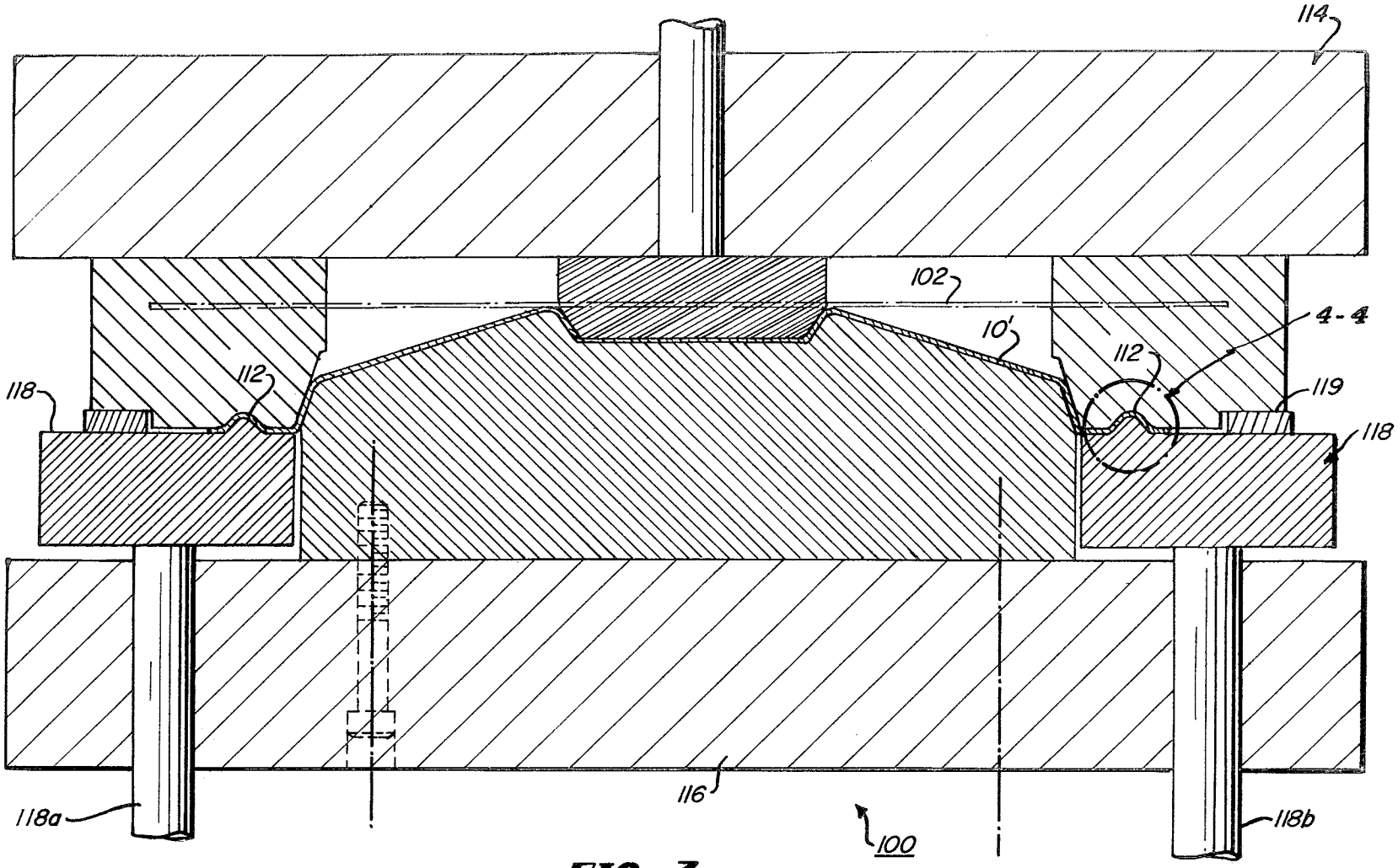
FIG. 3 is a fragmentary sectional detailed view taken in a radial plane through a die apparatus for producing the wheel cover members of the present invention.

Referring now to FIG. 3, there is shown a fragmentary sectional view, taken through a radial plane, of die apparatus 100 in accordance with the present invention. Apparatus 100 is shown in conjunction with a precut blank of aluminum material 102. The finished part of this step in the manufacturing operation is shown as member 10'. Die apparatus 100 includes an upper die 114 and a lower die 116. Die apparatus 100 further includes an air ring die 118 which is coaxially movably mounted about lower die 116. Air ring die 118 cooperates with complementary structure of upper die 114 to form the phantom draw bead 112. Vertical movement is imparted to air ring die 118 by way of air pins **118*a* and 118*b*, which function to urge air ring die 118** upwardly.

In operation, precut blank 102 is placed over lower die 116 and in contact with the projecting portions of air ring die 118 which form the phantom draw bead 112. Thereafter, the dies are partially closed by lowering upper die 114 until the outer annular portion of upper die 114 engages blank 102 and forms phantom draw bead 112. It can be seen that once the cooperating dies close about blank 102, draw bead 112 is initially formed along an outer annular margin of the draw blank. Thereafter, further downward movement of the upper die 114 toward lower die 116 causes the unformed central or generally inward portion of blank 102 to be pulled over the lower or stationary die 116, thereby to draw blank 102 into its initial formed configuration.

In currently preferred practice, a predetermined clearance is provided between the portions of the blank-and-draw dies, which form phantom draw bead 112. Accordingly, during the last portion of the blank-and-draw operation wherein the central portion of the blank is pulled over the lower or stationary die, a controlled flow of the aluminum material is accomodated, thereby to provide a given deep draw depth without necessitating a second or subsequent blank-and-draw operation. For example, in one constructed embodiment using 0.030 inch gauge aluminum, of the 52 52 -H25 type, a clearance between the closed dies of 0.001 inch was provided. This clearance is provided within a range of values which is neither too tight nor too loose and is maintained by adjustable spacers 119. That is, too little clearance can result in cracking of the aluminum material and a clearance which is too loose will result in a "loose" part. Stated differently, the loose part situation is one where the metal is not pulled tightly over the surface of the punch, male or stationary die, and accordingly, the material does not conform to all of the male surfaces of the stationary die.

Figure 4:
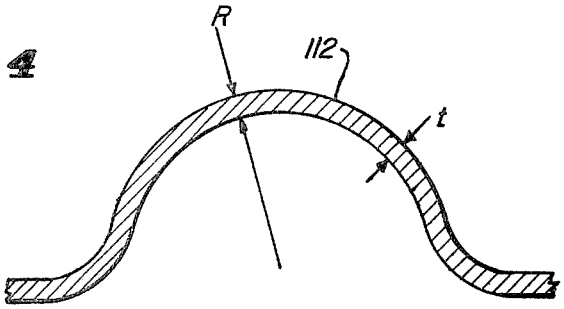
FIG. 4 is a fragmentary cross sectional view of a portion of the phantom draw bead in accordance with the present invention.

As will be described more fully hereinafter, the cross-sectional configuration of phantom bead 112, as best illustrated in FIG. 4, is smoothly contoured. Further, it will be appreciated by those skilled in the art that the relative size of phantom bead 112 is substantially greater than that which is ordinarily used as a draw bead in the art. For example, in the "Keiser Aluminum Data Book", entitled Automotive Development, Forming Drawing and Forming, and dated November, 1973, at page 3 thereof, it is taught that the radius of a draw bead for aluminum material should be in the range of 3 to 7 times the thickness of the material; and, at page 8 thereof, a formula for the radius (R) is given as $R=12.56^{t}$, where t represents the thickness of the material. However, in one constructed embodiment in accordance with the present invention, the corresponding radius was on the order of 0.3 inches whereas the material thickness was 0.03 inches, which radius is on the order of ten times the thickness of the material and which is almost 50% greater than the maximum recommended by those skilled in the art. Significantly, the greater radius of the phantom draw bead and its smoothly contoured configuration, in accordance with the present invention, permits the desired degree of controlled flow of the aluminum without deleteriously affecting its Class A finish and nevertheless provides the conventional "clamping" function of a draw bead. That is, the phantom bead, in accordance with the present invention, even though it is "too large" by conventional standards, still functions to provide its indispensable role in the drawing operation.

Subsequent to the blank-and-draw operation performed by the apparatus depicted in FIG. 3, the partially formed wheel cover member is slightly trimmed to cut off the "ears" which appear along the outer margin of the product of the apparatus of FIG. 3 due to the inherent characteristics of the aluminum material. That is, there is a tendency for the aluminum to creep along a dimension which is at 45 degrees to the grain of the aluminum material of the blank. Thus, the product of the blank-and-draw operation exhibits this well known "ear" phenomenon. Accordingly, the partially formed blank is trimmed in preparation for the subsequent restrike operation performed by the apparatus depicted in FIG. 5.

Figure 5:
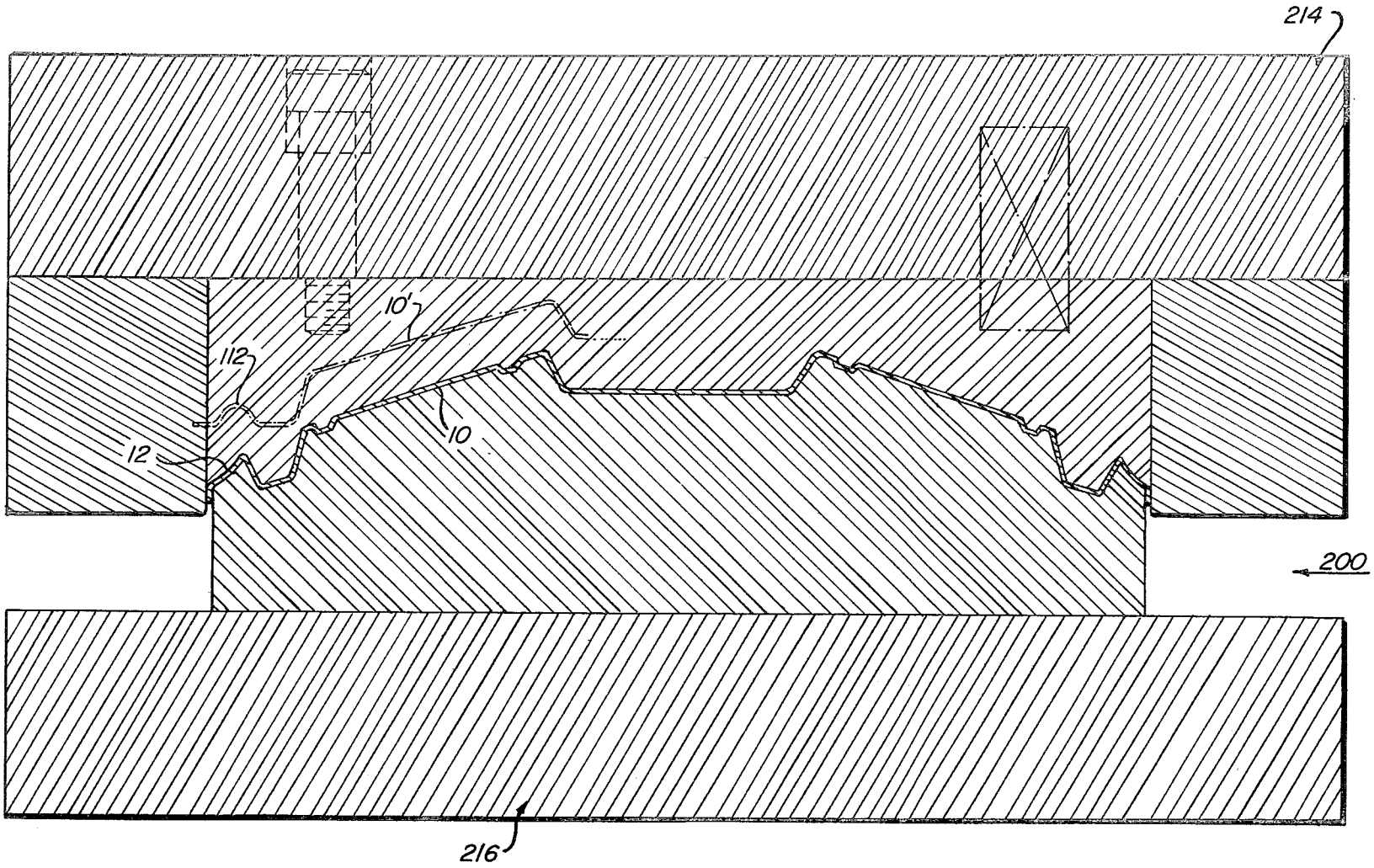
FIG. 5 is a fragmentary sectional view taken in a radial plane through restrike die apparatus which is used to complete the finished product of the present invention after the operation of the apparatus depicted in FIG. 3; and, FIG. 6 is another fragmentary sectional view of an optional die apparatus which is utilized to extrude a center portion of the finished product.

Referring to FIG. 5, there is shown a fragmentary sectional detailed view taken through a radial plane of the subsequent or restrike die apparatus in accordance with the present invention. Restrike die apparatus 200 includes an upper die member 214 and a lower or stationary die 216. The partially formed blank 10' is placed between the dies and the dies are thereafter closed to complete the forming operation of the aluminum wheel cover member. It can be seen that once the restrike dies are closed, the previously utilized phantom bead 112 is formed into the first peak-like rib 12 of completed wheel cover member 10.

Figure 6:
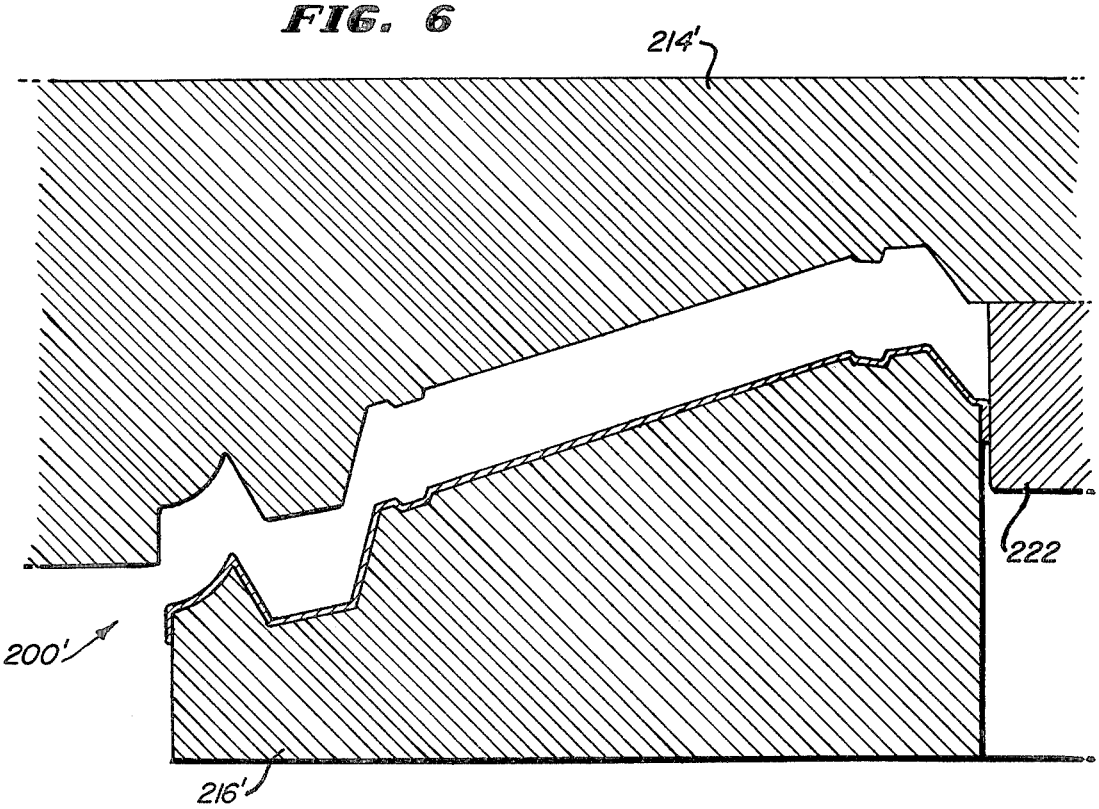

Referring now to FIG. 6, there is shown additional die apparatus. Apparatus 200' of FIG. 6 is similar to the restrike apparatus 200 of FIG. 5, and accordingly, like elements bear like reference numerals. The apparatus of FIG. 6 essentially differs from the apparatus of FIG. 5 in that a central die member 222 is added. Die member 222 functions to extrude the central portion of wheel cover member 10 into a configuration which can accomodate a medallion or ornamental member as desired. However, it should be noted that such an operation is merely optional as the ornamental configuration of the finished wheel cover member may take any one of a number of suitable shapes. For example, the entire central portion can be relatively flat or gradually sloped. Further, the peaked rib 12 may be deleted entirely and a relatively flat or gradual contour can be substituted therefor. Of course, a valve stem hole or other structural features can be added by using conventional techniques well known in the art. Thus, the particular design configuration illustrated in the foregoing figures is merely for purposes of illustration.

In currently preferred practice, the finished product of the foregoing described process is fastened to a stainless steel retention band by spinning the edge portion 11 over a corresponding flange of the retention band. This spinning process is utilized to lessen or avoid the phenomenon known as "crazing" which can result from fastening techniques such as a stamping process. It will be appreciated by those skilled in the art, however, that aluminum wheel cover member 10 may be provided with any one of a number of suitable retention means. Further, aluminum wheel cover member 10 may also be provided with integral retention means. However, in currently preferred practice, wheel cover member 10 is joined or suitably fastened with a relatively hard retention ring having retention teeth of a material of a much greater resiliency than aluminum. This is done to meet the current industry standards regarding drop tests and torque tests which relate to the ability of a wheel cover to remain on an automotive wheel under essentially all road conditions.

Further, it should be appreciated that while the present invention has been described with reference to one particular ornamental design configuration, the invention is also applicable to any other desired form. However, it is known in the art that the elongation of aluminum is on the order of 10–12 percent whereas the elongation of stainless steel, for example, is on the order of 30–35 percent. This reduced elongation of aluminum does limit the axial depth of a given ornamental design. Thus, the designer is somewhat more limited with regard to pronounced cones or crowns in the surface or profile of an aluminum wheel cover. However, it should also be appreciated that a greater depth, nevertheless, can be attained by adding one or more die operations ("hits") in the overall manufacturing process.

Present day stainless steel wheel covers are typically specified, by the automotive industry, to a nominal thickness of 0.020 inches. In currently preferred practice, the thickness of the aluminum wheel cover, in accordance with the present invention, is selected to be a nominal 0.030 inch thickness for strength and dent resistance comparable to 0.020 stainless steel. The greater thickness of the aluminum material is not a disadvantage as it is nevertheless lighter in weight and less expensive than 0.020 stainless steel.

It will now be appreciated by those skilled in the art that the present invention provides three salient advantages as described hereinafter. First, the location, configuration and dimension of the phantom bead eliminates an additional hit or blank-and-draw step in the manufacturing operation. That is, if a draw bead were provided externally of the given finished dimension of the aluminum wheel cover member, two blank-and-draw operations, prior to the restrike operation, would be required as there would not be enough metal flow to accomodate any substantial degree of contouring in the ornamental configuration of the wheel cover. Stated somewhat differently, by providing the phantom bead within the given dimension of the finished product, (i.e., the bead having an annular diameter less than the diameter of the finished product), the controlled flow source is located further toward the central portion of the wheel cover member and accomodates the material flow to provide a given amount of ornamental depth or contouring.

Secondly, the phantom bead, in accordance with the present invention, functions as a conventional draw bead to secure or clamp the sheet metal blank during the performing operation so that the blank conforms to the male surfaces of the stationary or lower dies; but also results in being a part of the finished part while maintaining its initial Class A finish. That is, no further finishing is necessary to remove imperfections introduced into the material in the drawing and forming step, as the phantom draw bead in accordance with the present invention introduces no such imperfections when subsequently formed into the finished product configuration.

Thirdly, since the phantom bead in accordance with the present invention permits the use of an absolute minimum blank size —i.e., just enough oversizing to accomodate the resulting "ear" phenomenon—substantial savings of material are attained. In this regard, the material savings advantages can be graphically illustrated by considering the dimensions involved in one constructed embodiment. In producing wheel cover members of the type illustrated in FIGS. 1 and 2 of the present specification, a blank having a 17-inch diameter was utilized. If a conventional prior art draw bead were provided along an external outer annular margin of the blank, which margin is greater than the given diameter of the finished product, an approximately 18-inch blank would be required. Since, aside from the thickness of the material, the finished product has two major dimensions, the savings provided by the present invention is on the order of or in accordance with the square of the dimensions. That is, the square of 17 is 289 inches whereas the square of 18 is 324 inches. Thus, each wheel cover member is therefore provided with a savings of approximately 35 square inches, which is more than a ten percent material savings. It will be appreciated by those skilled in the art that this is a substantial savings.

It has been found that the present invention advantageously utilizes a characteristic of aluminum relating to its column strength. That is, the currently preferred nominal 0.030 gauge thickness of aluminum, because it is a thicker material with less tensile strength, enjoys a greater column strength than comparable stainless steel. Stated somewhat differently, aluminum does not wrinkle as readily as other materials, such as stainless steel, and a larger phantom bead can therefore be provided. For example, to draw and form a given plate of steel into the shape of a cup would require that the plate have a substantial thickness, perhaps on the order of $\frac{3}{8}$ inch, in order to achieve a sufficient degree of column strength to avoid wrinkling. Moreover, to practice the present invention—that is—the utilization of a phantom draw bead, with a stainless steel wheel cover, the gauge of the stainless steel would be on the order of 0.060 gauge thickness to attain sufficient column strength to avoid wrinkling. It should be appreciated that such a thickness of stainless steel would result in an inordinately heavy and expensive wheel cover.

What has been taught, then, is a method and apparatus for manufacturing aluminum wheel covers utilizing a phantom draw bead. The use of the phantom draw bead provides a substantial given draw depth using material which forms part of the finished product and which retains its Class A finish without further working, polishing or handling. Further, substantial material savings are also provided.

The form of the invention illustrated and described herein are but preferred embodiments of these teachings, in the form currently preferred for manufacture. They are shown as illustrations of the inventive concepts, however, rather than by way of limitation, and it is pointed out that various modifications and alterations may be indulged in within the scope of the appended claims.

I claim:

1. Apparatus for making generally circular wheel cover members of a given diameter from an aluminum sheet blank, said apparatus comprising, in combination:

an upper die;

a lower cooperating die;

means for moving said dies toward and away from each die;

one of said dies having a groove along a generally outer annular marginal portion thereof for cooperating with complementary structure on the other of said dies for forming a draw bead along a corresponding generally outer annular portion of said blank when said dies are moved toward each other;

wherein said dies include means for providing a predetermined separation between said groove and said complementary structure when said dies form said draw bead and wherein said predetermined separation is significantly greater than the thickness of said blank;

one of said dies further including die structure which is operative after said draw bead is formed to form the central portion of said wheel cover by pulling the central portion of said blank over said die structure as said dies are closed and while said groove and said complementary structure effectively clamp said outer annular portion of said blank so that said central portion of said blank conforms to the surface of said die structure; and, wherein the diameter of said groove is less than said given diameter.

2. The apparatus according to claim 1, wherein said predetermined separation is approximately 0.001 inch greater than the thickness of said blank.

3. The apparatus according to claim 1, wherein the radius of said groove is in the range of 8 to 12 times the thickness of said blank.

4. The apparatus according to claim 6, wherein said radius is 10 times the thickness of said blank.

* * * * *